United States Patent [19]

Shepherd

[11] Patent Number: 4,531,503

[45] Date of Patent: Jul. 30, 1985

[54] FLUID PRESSURE REPEATING PISTOL WITH UNITARY BARREL AND HAMMER ASSEMBLY

[76] Inventor: Robert G. Shepherd, 1513 Sewanee Dr., West Columbia, S.C. 29169

[21] Appl. No.: 581,535

[22] Filed: Feb. 21, 1984

[51] Int. Cl.[3] ..... F41B 11/06

[52] U.S. Cl. ..... 124/76; 124/50; 124/74

[58] Field of Search ..... 124/31, 50, 67, 68, 124/74, 76; 42/10, 11; 89/1 K, 161

[56] References Cited

U.S. PATENT DOCUMENTS

| | | | |
|---|---|---|---|
| 2,132,173 | 10/1938 | Lefever | 124/67 |
| 2,151,676 | 3/1939 | Appleby | 124/67 |
| 2,817,328 | 12/1957 | Gale | 124/76 X |
| 3,204,625 | 9/1965 | Shepherd | 124/76 X |
| 3,552,372 | 1/1971 | Wilkerson | 124/67 |
| 4,028,994 | 6/1977 | Ferluga | 42/10 X |
| 4,147,152 | 4/1979 | Fischer et al. | 124/76 |
| 4,212,285 | 7/1980 | Cagan et al. | 124/67 |
| 4,289,109 | 9/1981 | D'Andrade | 124/67 |

FOREIGN PATENT DOCUMENTS

| | | | |
|---|---|---|---|
| 137454 | 9/1952 | Sweden | 124/76 |

*Primary Examiner*—Richard T. Stouffer
*Attorney, Agent, or Firm*—Kemon & Estabrook

[57] ABSTRACT

A single-action, gas powered repeating pistol has a sliding unitary barrel and hammer assembly with the barrel and hammer aligned on opposite sides of a fixed pressure chamber. In the uncocked condition, the hammer extends rearwardly of the main frame so that cocking may be effected by merely slapping the rear of the hammer to force the assembly forward to be retained by a trigger mounted sear.

3 Claims, 2 Drawing Figures

FLUID PRESSURE REPEATING PISTOL WITH UNITARY BARREL AND HAMMER ASSEMBLY

BACKGROUND OF THE INVENTION

There has recently come into vogue a type of game mainly for adult participation based on the theme of survival under war like conditions. The weapons used in these games are generally pistols which fire hollow projectiles filled with dye. When these projectiles strike a game participant, the projectile shatters and the dye leaves a clearly visable spot on the participants uniform. The pistols are fluid pressure operated and generally of the single action repeating type. The present invention is directed particularly to a pistol of this type for use in these types of games where accuracy and rapidity of fire are prime considerations.

A pistol of this general type is shown for example in U.S. Pat. No. 4,147,152 of Apr. 3, 1979.

BRIEF SUMMARY OF THE INVENTION

The pistol of the present invention is an improvement over that as shown in the above mentioned patent both because of its simplicity, fewer number of parts and the rapidity and ease with which the pistol may be cocked. Generally speaking, a unitary barrel and hammer assembly are slidably mounted on the main frame and spaced on opposite sides of a pressure chamber housing the valve which controls the admission of pressure to the barrel. In the fired or uncocked position of the gun, the hammer extends rearwardly of the handle and main frame so that the user has only to slap the hammer with his free hand in order to cock and reload the pistol.

DETAILED DESCRIPTION OF THE DRAWINGS

Figure 1:
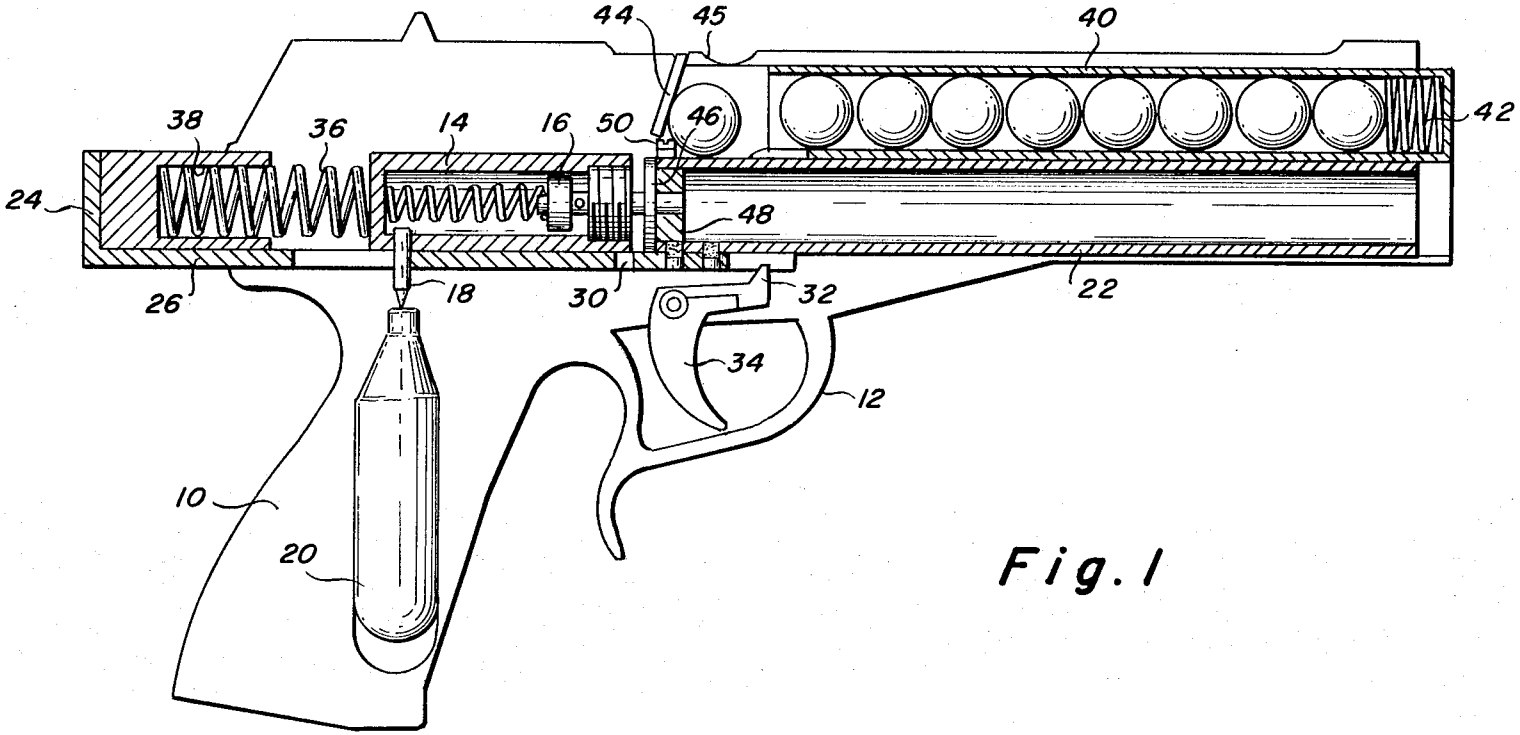
FIG. 1 is a side elevation partially in section showing the operative parts of the gun in uncocked or just fired position.

Referring first to FIG. 1, the pistol includes a main frame including a handle portion 10 and trigger guard 12. Fixedly positioned on the main frame is a pressure chamber 14 having a valve 16 at its forward end and a means 18 for communicating with the interior of a disposable pressure source 20 housed within the handle 10. Slidably mounted barrel 22 and hammer 24 are connected to form a unitary assembly by means of a cocking bar 26. The cocking bar is slotted at 28 in order to permit sliding movement with respect to the means 18 and the bar also includes an opening 30 to receive the sear 32 of a pivotally mounted trigger 34. The barrel-hammer assembly is rearwardly biased by means of a spring 36 positioned between the pressure chamber 14 and a bore 38 in the hammer.

A tubular magazine 40 is also fixedly carried on the main frame and includes a spring 42 to urge the projectiles in the magazine toward the rear of the gun. A wall 44 of the main frame is slanted as shown to direct individual projectiles downwardly of the magazine. The upper surface of the main frame above the rear of the magazine has a hole 45 for reasons which will appear hereinafter.

Rigidly carried on the stem of the valve 16 is a flange 46 engageable by the rear surface of the barrel to effect momentary opening of the valve as well as a sealing member 48 which enters the rear portion of the barrel to provide a seal between the barrel and the pressure source during actual firing.

Figure 2:
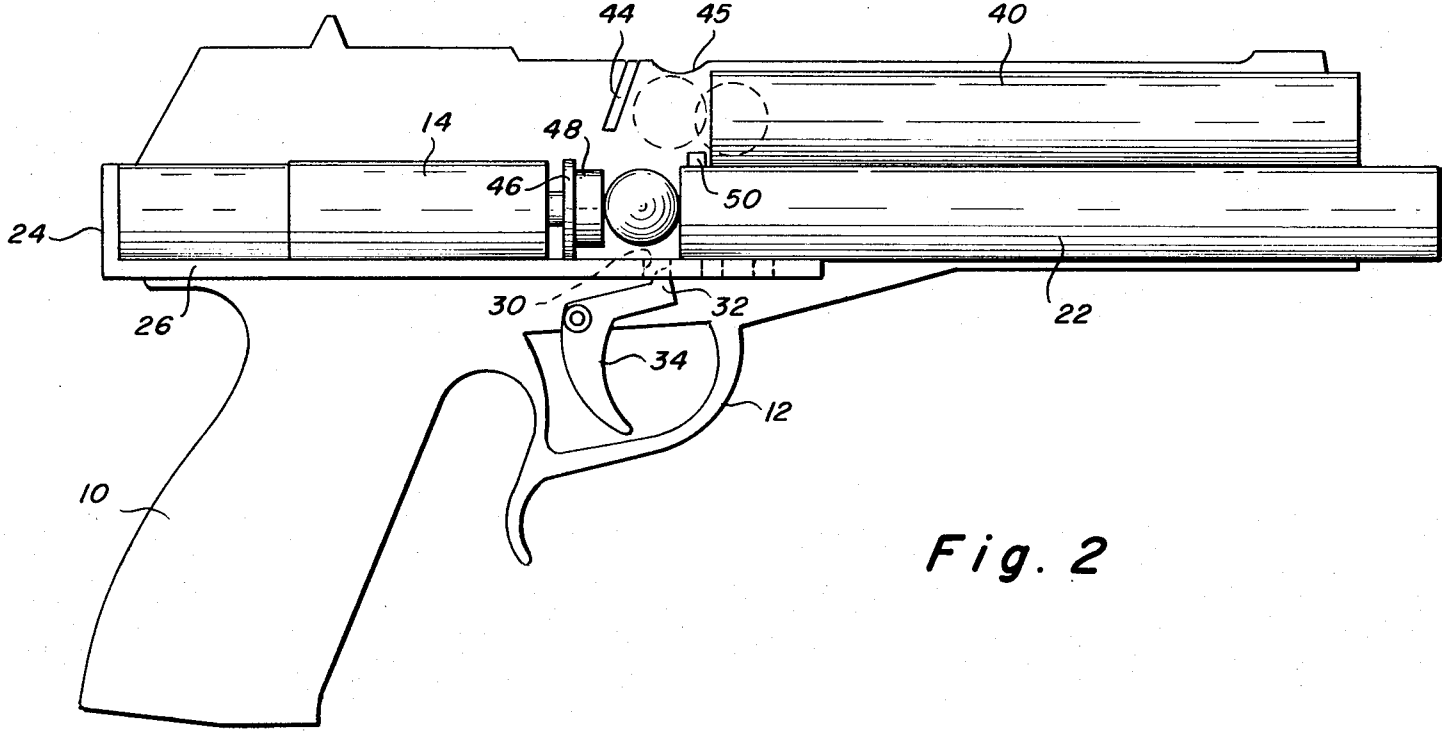
FIG. 2 is a view similar to FIG. 1 but showing the same parts in cocked or ready to fire position.

In order to move from the fired position of FIG. 1 to the cocked position of FIG. 2, it is only necessary to move the hammer forwardly until the sear 32 becomes engaged in the opening 30 of the cocking bar. There is a protrusion 50 on the upper rear surface of the barrel which as the hammer and barrel move toward cocked position will engage the underside of the rearmost projectile in the magazine and raise it upwardly partially into the opening 45. In the cocked position of the barrel the protrusion as shown in FIG. 2 blocks rearward movement of the next projectile in line but permits the rearmost one to fall into the position shown in full line in FIG. 2.

When the gun is fired by squeezing the trigger 34, the hammer-barrel-cocking bar assembly is moved rearwardly by means of the spring 36 so that the barrel first encloses the projectile shown in full line in FIG. 2 and finally impinges on the flange 46 to momentarily open the valve by moving the valve slightly rearwardly of the position shown in FIGS. 1 and 2 and transmit pressure into the interior of the barrel to fire the projectile forwardly. The momentary opening of the valve, of course, is due to the inertia of the rearwardly moving barrel assembly which then returns to its rest position shown in FIG. 1. The seal member 48 assures that all of the pressure is transmitted into the barrel and utilized to expel the projectile therefrom.

With this structure, as will be apparent to those skilled in this art, once the pistol has been fired, it may be cocked and made ready for refiring by merely slapping the rear of the hammer 24 with that hand of the user which is not holding and firing the gun.

While a preferred embodiment of the present invention has been herein shown and described, applicant claims the benefit of a full range of equivalents within the scope of the appended claims.

I claim:

1. A repeating pistol of the fluid pressure powered type comprising:

a main frame including a handle portion;

means defining a closed chamber fixedly mounted on said main frame and including means affording connection of said chamber to a source of fluid pressure, and having a normally closed valve at its forward end;

a unitary assembly slidably mounted on said main frame including a barrel forwardly of and a hammer rearwardly of said chamber, said assembly being biased rearwardly and movable between a forward cocked position, a rearmost firing position and a fired or rest position just forward of the firing position;

a trigger pivotally mounted on said frame and having a sear engageable with said assembly for releasably holding said assembly in forward cocked position;

and sealing means carried by said valve and engageable by the rear of said barrel to establish sealed temporary fluid communication between said chamber and the rear of said barrel when said barrel moves from its cocked to its firing position;

said hammer in its rest position extending rearwardly of said main frame and handle portion whereby a user may cock the pistol while holding it substantially in firing position by merely slapping the hammer with his other hand.

2. A pistol as defined by claim 1 and having a magazine carried by said main frame above said barrel and means for moving a projectile rearwardly of said magazine and downwardly into alignment with the rear of said barrel whenever said barrel is moved to its forward cocked position so that when the pistol is fired, the barrel moves rearwardly, enclosing the projectile before engagement with said sealing means to fire the projectile forwardly.

3. A pistol as defined by claim 2 including a protrusion on the upper rear surface of said barrel which in the cocked position of the barrel forms a stop against which the rearmost projectile in said magazine rests.

* * * * *